United States Patent [19]

Berlie et al.

[11] 4,392,817

[45] Jul. 12, 1983

[54] WASTE GAS INCINERATOR WITH ADDED FUEL GAS

[75] Inventors: Elmer M. Berlie; John D. Smart; Michael J. Zelensky, all of Alberta, Canada

[73] Assignee: Western Research & Development, Calgary, Canada

[21] Appl. No.: 239,554

[22] Filed: Mar. 2, 1981

[51] Int. Cl.[3] ..... F23D 13/20

[52] U.S. Cl. ..... 431/202; 422/182; 431/5

[58] Field of Search ..... 431/202, 5, 285, 284; 422/182

[56] References Cited

U.S. PATENT DOCUMENTS

| | | | |
|---|---|---|---|
| 3,628,903 | 12/1971 | Hoyt | 431/202 |
| 3,836,318 | 9/1974 | Desty et al. | 431/202 |
| 3,930,802 | 1/1976 | Beasley et al. | 431/202 X |
| 3,933,420 | 1/1976 | Zink et al. | 431/202 |
| 3,982,881 | 9/1976 | Schwartz et al. | 431/202 |
| 4,070,146 | 1/1978 | Straitz | 431/202 |
| 4,101,261 | 7/1978 | Straitz | 431/202 |
| 4,140,471 | 2/1979 | Straitz et al. | 431/5 |

*Primary Examiner*—Edward G. Favors
*Attorney, Agent, or Firm*—Larson and Taylor

[57] ABSTRACT

A waste gas incinerator for burning waste gases with additional fuel gas is disclosed. The incinerator uses the additional fuel more efficiently than other types of flares and can operate in high wind conditions. The incinerator comprises an upright refractory lined generally cylindrical casing forming a combustion chamber and heat sink, and has an open upper end and lower end. An upper wind shroud is provided adjacent the open upper end and a lower wind shroud adjacent the lower end, both wind shrouds have a generally cylindrical shape with a larger diameter than the casing and a plurality of openings spaced around the wind shrouds. Air access is provided at the lower end of the casing, the access has a restrictor to limit air entry and cause turbulent air flow in the casing. A fuel gas entry is located at the lower end of the casing, and a waste gas supply system within the casing has a preheater for preheating the waste gases with combustion of fuel gas and air, and causes turbulence of the waste gases. A waste gas entry is provided into the casing at a location where the fuel gas and air have commenced combustion.

9 Claims, 5 Drawing Figures

WASTE GAS INCINERATOR WITH ADDED FUEL GAS

The present invention relates to waste gas flares and more particularly to the incineration of waste gases from industrial operations, including oil and gas wells, wherein additional fuel gas is required to ensure complete combustion.

Waste gases have been burned for a number of years, using flares, typically a pipe with an elevated exit. Such gases include combustible gases mixed with inert gases such as nitrogen and carbon dioxide and also generally include toxic or odoriferous gases such as hydrogen sulfide and mercaptans. In some waste gases, not sufficient combustible gas is present for complete combustion, and it is found that additional fuel gas must be mixed with the waste gas to ensure complete combustion of the toxic and odoriferous gases. Without additional fuel gas the toxic and odoriferous gases are not fully consumed and merely exhaust from the pipe exit causing unpleasant odors in the surrounding area. Even with the additional fuel gas it is still found that flares do not always consume all the toxic and odoriferous gases due in part to variation in waste gas flow and also to changes in wind conditions which can result in incomplete combustion of these gases. To partially overcome this problem, it has been found that incinerators can be located on the top of a waste gas pipe exit.

Waste gas incinerators have been partially successful in the past, however, a number of problems have occurred with these incinerators. In the case where additional fuel gas is added to the waste gases, it is often difficult to use the fuel gas efficiently and in some cases not all the fuel gas is consumed. Another problem is high winds which cause low pressure areas resulting in down-draughts within the incinerator and downwash outside the incinerator. In some cases the flame is blown out, in other cases combustion occurs outside the incinerator which cools the burning waste gases resulting in incomplete combustion, particularly of the toxic compounds.

One example of an incinerator which overcomes some of the above problems is disclosed in my copending application, Ser. No. 239,553 filed concurrently herewith. This incinerator solves the problems that occur due to high winds by having upper and lower wind shrouds. It also provides a restricted turbulent air flow into the combustion chamber of the incinerator to improve combustion therein, but it does not provide additional fuel gas to consume all the toxic and odoriferous gases.

We have found that an improved waste gas incinerator for incinerating waste gases with additional fuel gas may be formed from a refractory lined pipe, larger in diameter than the waste gas pipe line, to form a combustion chamber. The waste gas is preheated in this combustion chamber before being fed into the combustion chamber at a location where the fuel gas and air are in combustion. We have found that by preheating the waste gases a minimum of additional fuel gas is needed to achieve substantially complete combustion of the waste gases. The combustion chamber has at least one opening at the lower end and is open at the upper end. The lower opening forms an air access which has a restriction therein so the amount of air entering the combustion chamber from the lower opening is controlled. Thus, there is no free laminar air flow into the combustion chamber, but rather a restricted turbulent air flow. This restricted turbulent flow minimizes excess air and ensures substantially complete combustion occurs regardless of the quantity of waste gases and additional fuel gas entering the combustion chamber. A flame may protrude from the top of the incinerator at high flow rates.

Two other features of the present invention include a lower wind shroud around the lower opening of the refractory lined pipe, and an upper wind shroud around the open upper end of the refractory lined pipe. The wind shrouds prevent areas of low pressure occurring at the bottom opening and open top which may affect complete combustion of the waste gases.

The present invention provides a waste gas incinerator for burning waste gases with additional fuel gas, comprising an upright refractory lined generally cylindrical casing forming a combustion chamber and heat sink, having an open upper end and a lower end, an upper wind shroud adjacent the open upper end and a lower wind shroud adjacent the lower end, both wind shrouds having a generally cylindrical shape with a larger diameter than the casing, air access at the lower end of the casing within the lower wind shroud, the access having a restriction means to limit air entry and cause turbulent air flow in the casing, fuel gas entry at the lower end of the casing, waste gas supply system within the casing having preheating means for preheating the waste gases with combustion of fuel gas and air, and waste gas entry into the casing at a location where the fuel gas and air have commenced combustion.

In preferred embodiments of the invention the upper wind shroud and the lower wind shroud have a plurality of vertical slots spaced around the generally cylindrical shape. In another embodiment the vertical slots in the wind shrouds represent about half the area of the generally cylindrical shape. A pilot light may be mounted within the casing adjacent the fuel gas entry. In another embodiment the restriction means in the air access includes a plurality of air vanes positioned at an angle to give air entering the air access a swirling action to mix with the fuel gas and the waste gases within the casing. In another embodiment, a preheating means for the waste gases includes a helical vane within an axial waste gas entry pipe, and a conical deflector at the top of the entry pipe. In a still further embodiment the preheating means for the waste gases includes an axial waste gas entry pipe having a second larger pipe coaxial with the entry pipe providing an upward passage and a downward passage for the waste gases within the casing.

In yet a further embodiment there is provided a method for incinerating waste gases with a fuel gas in an upright refractory lined, generally cylindrical casing, having an open upper end and a lower end, comprising the steps of, feeding the fuel gas to the lower end of the casing, preventing a low pressure area at the lower end of the casing due to wind by means of a lower wind shroud, admitting a limited amount of air in a turbulent flow to the lower end of the casing to mix with the fuel gas, igniting the mixture of the air and the fuel gas within the casing, preheating the waste gases within the casing, feeding the preheated waste gases into the casing to mix with the air and the fuel gas, maintaining combustion of the fuel gas and waste gases within the casing at a sufficient temperature and for a sufficient time to attain substantially complete combustion of the waste gases before discharging from the open end of the casing, and preventing quenching and downwash at the open end of the casing due to wind, by means of an upper wind shroud.

In drawings which illustrate embodiments of the invention,

Figure 3:
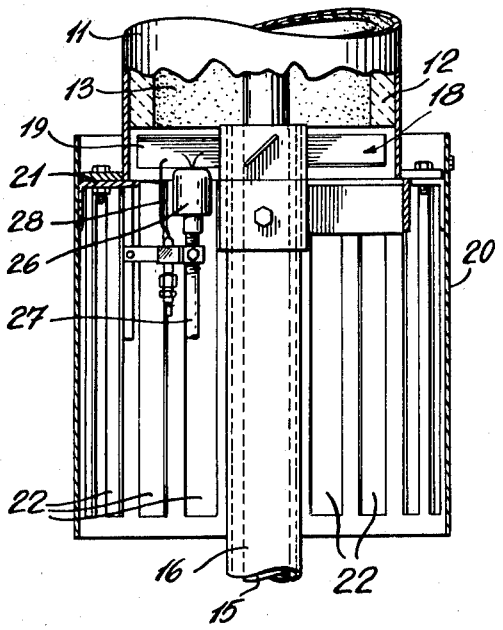
Figure 2:
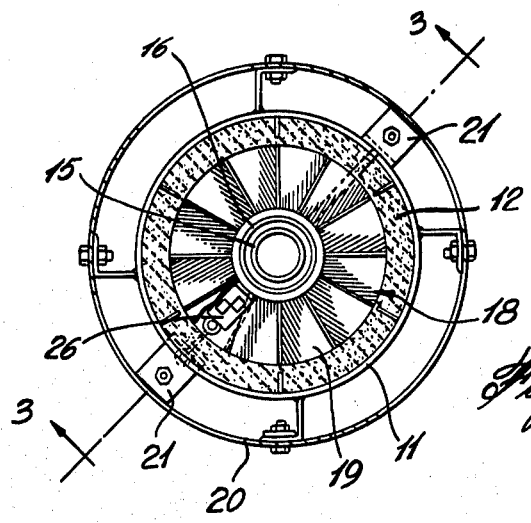
FIG. 2 is a cross sectional view taken at line 2—2 of FIG. 1.

FIG. 3, shown on the first page of drawings, is a longitudinal sectional view taken at line 3—3 of FIG. 2.

Figure 4:
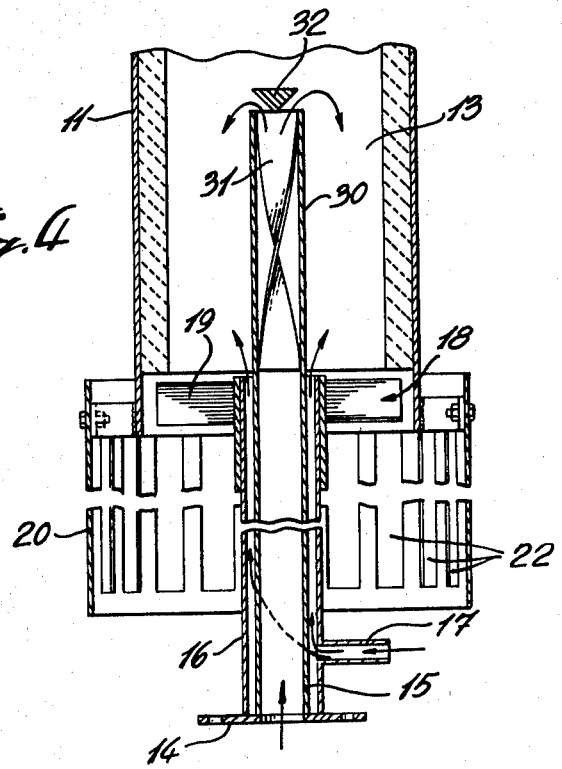

FIG. 4 is a sectional view through the lower wind shroud of a waste gas incinerator, illustrating one embodiment of a waste gas preheater.

Figure 5:
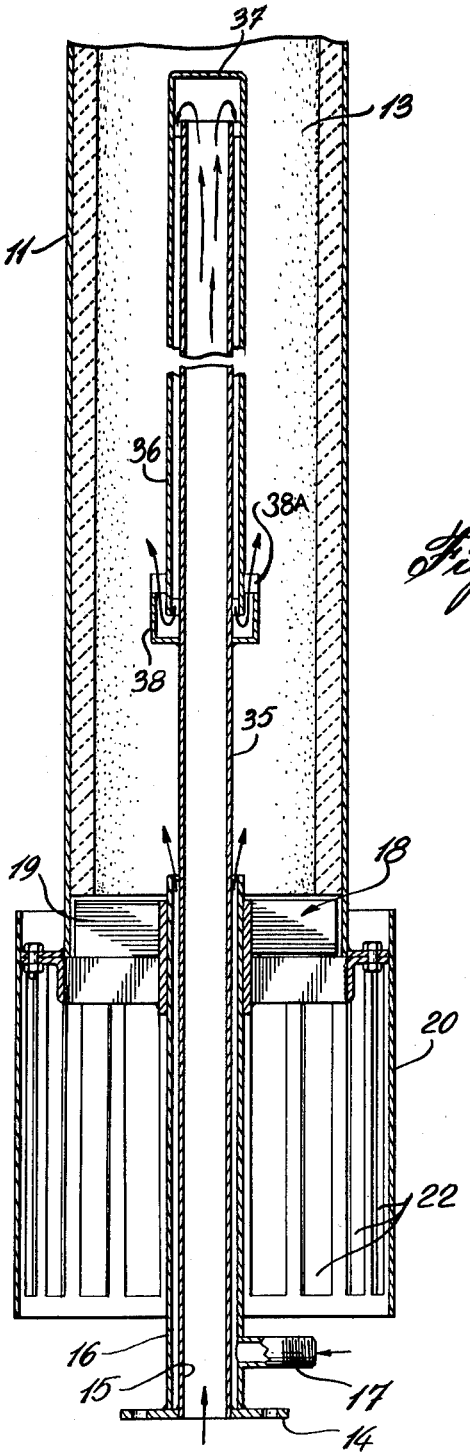

FIG. 5 is a sectional elevational view similar to that shown in FIG. 4, illustrating another embodiment of a waste gas preheater.

Figure 1:
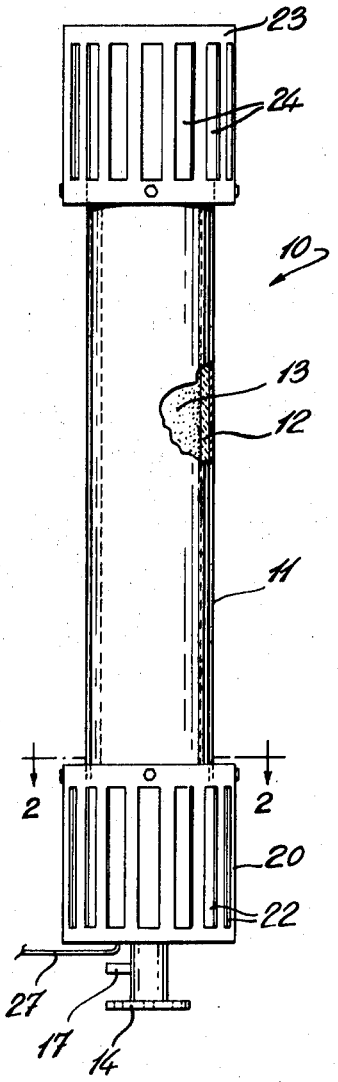
FIG. 1 is an elevational view of a waste gas incinerator with provision for additional fuel gas, according to one embodiment of the present invention.

Referring now to FIGS. 1-3, a waste gas incinerator 10 is shown having a generally cylindrical casing 11 lined with refractory material 12. The refractory liner is preferably made from clay-cast refractory material to provide an insulator and heat sink to form a combustion chamber 13 within the casing 11. The incinerator 10 is mounted on top of a waste gas pipe (not shown) by means of a flange 14. A waste gas pipe line 15 extends upwards from the flange 14 and has a co-axial pipe 16 surrounding the waste gas pipe line 15 to provide a supply line for additional fuel gas which enters by means of a fuel gas entry pipe 17.

At the lower end of the chamber 11 is an air restrictor 18 which comprises a plurality of vanes 19 extending from the outside surface of the co-axial pipe 16 towards the internal surface of the casing 11. The number of vanes 19 and the angle of vanes is dependent upon the air flow requirement into the combustion chamber 13. If there is insufficient restriction, too much air enters into the chamber 13, and the temperature of combustion may be below that at which some of the toxic and odoriferous compounds are consumed. If there is insufficient air entering the chamber 13, complete combustion does not take place. The co-axial pipe 16 terminates directly above the air restrictor 18 and air entering the combustion chamber 13 is given a turbulent flow which causes it to mix with additional fuel gas entering the chamber 13 from the co-axial pipe 16. The waste gas pipe line 15 extends up above the end of the co-axial pipe 16 and when the fuel gas exiting from this co-axial pipe 16 burns in the air, the waste gas pipe line 15 is heated.

A lower wind shroud 20 cylindrical in shape with an open top and bottom is supported on brackets 21 over the lower end of the casing 11. In the embodiment shown, the lower wind shroud 20 has a plurality of vertical slots 22. The slots 22 preferably represent approximately half the circumferential area of the lower wind shroud 20. Whereas vertical slots are shown in the drawing, round holes or almost any shape of openings are satisfactory, however, it is preferred that the openings represent approximately half the circumferential area of the shroud. An upper wind shroud 23 cylindrical in shape with an open top and bottom is positioned over the open upper end of the casing 11 and in the embodiment shown has a plurality of vertical slots 24 as in the lower wind shroud 20. As in the lower wind shroud 20 it is preferred that the slots 24 represent approximately half the circumferential area of the upper wind shroud 23. Whereas vertical slots are shown in the drawing, round holes or almost any shape of openings are satisfactory, however, it is preferred that the openings represent approximately half the circumferential area of the shroud. The upper wind shroud 23 is preferably made from stainless steel so that it can withstand the high temperatures of combustion and hot gases exiting from the combustion chamber 13. The lower wind shroud 20 may be made from aluminum as it acts only on air entering the air restrictor 18. In practice it has been found that during high winds, the lower wind shroud 20 prevents areas of low pressure adjacent the air restrictor 18 and within the combustion chamber 13, thus allowing a substantially constant flow of air into the combustion chamber 13 at practically all wind conditions. Furthermore, it has been found that if there is a variation in the fuel gas flow and waste gas flow into the combustion chamber 13 then the air entering the chamber 13 through the air restrictor 18 varies to a certain extent to match this required air flow to ensure complete combustion of the waste gases. The upper wind shroud 23 prevents downdraughts into the combustion chamber 13 which creates an adverse effect on combustion within the chamber 13. The upper wind shroud 23 also prevents quenching of the flame at the open top of the incinerator and acts as a flame holder within which combustion of hydrogen, carbon monoxide and light hydrocarbon materials such as methane are completed.

A pilot light 26 is provided below the air restrictor 18 within the lower wind shroud 20. The pilot light 26 has a fuel gas pipe line 27 to fuel the pilot light and an electric ignition system 28 is provided to ignite the pilot light if it should go out. An access door (not shown) may be provided in the lower wind shroud 20 for maintenance of the pilot light.

Referring now to FIG. 4 the waste gas pipe line 15 extends upwards into the combustion chamber 13 to form a preheater 30. Inside the preheater 30 is a helical deflector 31 to cause a swirling action to the waste gases and increase heat transfer. An inverted cone 32 is positioned at the top of the preheater 30 to provide a deflector for the waste gases as they exit from the preheater 30 and to enhance mixing of the swirling gases in the combustion chamber. As is seen in FIG. 3 the fuel gas and air ignites below the exit from the preheater 30 thus the exiting waste gases are immediately subjected to combustion and as they have been preheated the toxic and odoriferous compounds are consumed. Variations in flow of the fuel gas may be made to accommodate particular types of waste gases, in some cases waste gases require very little fuel gas, in other cases larger quantities are required depending on the heating value of the waste gases.

A further embodiment of a preheater is shown in FIG. 5 wherein the waste gas pipe line 15 extends upwards to form a preheater 35 within the combustion chamber 13. A co-axial pipe 36 is positioned around the preheater 35 having a cap 37 at the top thereof so that the waste gases pass to the very top of the preheater 35 and then move downwards in the co-axial pipe 36 to a collar 38 which directs the waste gases upwards through a plurality of swirling vanes 38A so they are given a swirling turbulent motion as they enter the combustion chamber 13 at a location where combustion is occurring between the fuel gas and the air. Thus the waste gases are preheated before they commence burning. The height of the waste gas incinerator is determined by the residence time for the waste gases within the incinerator. This residence time must be of sufficient duration and the temperature sufficiently high to ensure substantially complete combustion of all the toxic and odoriferous compounds, but at high flow rates a flame may protrude from the open upper end of the chamber.

In one embodiment the incinerator has a total length of 8 feet with a 5 foot casing length. The height of the upper wind shroud and bottom wind shroud is approximately 18 inches. The diameter of the casing is approximately 12 inches with a 1 inch thick refractory lining. The outside diameter of the two wind shrouds is approximately 17 inches. The waste gas pipe line 15 is approximately 2 inches in diameter and the co-axial pipe 16 is approximately 3 inches in diameter. In one embodiment the incinerator is supported by pivot pins (not shown) at the center of the casing and mounted on a mobile sled by means of support brackets. In this form the unit may be installed temporarily at a desired field location and may be shipped from one location to another by swinging the incinerator through 90 degrees so that it can be transported in the horizontal position and then raised to the vertical position when installed in another field location.

In another embodiment the incinerator may be mounted above ground level on top of a waste gas pipe line which in a typical installation extends upwards for at least about 40 feet above the ground. Due to complete combustion of the waste gases within the incinerator, minimum additional fuel gas is needed to consume the odoriferous and toxic gases. No compressed air is needed, the air is provided by a natural draught, and the unit is mobile for use in more than one location. A UV scanner may be provided to ensure the pilot light 26 is kept lit and the electrical ignition system 28 is functioning.

In operation the fuel gas enters the combustion chamber 13 and mixes with a turbulent flow of air entering through the air restrictor 18. Combustion occurs which commences to heat the waste gases in the preheater 35. The waste gases from the preheater 35 exit into the combustion chamber 13 where the fuel gas is burning and the temperature is reasonably hot. The waste gases are substantially consumed within the combustion chamber 13 before exiting at the open upper end of the casing 11. Combustion occurring within the chamber 13 is at a sufficiently high temperature and for a sufficient duration of time to ensure substantially complete combustion of the toxic and odoriferous compounds within the chamber 13 so that only consumed gases are discharged from the open upper end of the casing 11. At high flow rates a flame may protrude from the open upper end of the chamber 13. The lower wind shroud 22, which surrounds the air restrictor 18 prevents low pressure areas within the combustion chamber 13 and ensures that there is a reasonable constant flow of air through the air restrictor 18 regardless of wind conditions. The upper wind shroud 23 prevents quenching and downwash at the open upper end of the casing 11, and only at high flow rates does some waste gas burn outside the casing 11.

Various changes to the embodiments illustrated herein may be made without departing from the scope of the present invention. It is important that air flow be restricted and turbulent within the combustion chamber, that the waste gases be preheated before entering the combustion chamber, and there is a sufficiently high temperature within the chamber, and the height of the chamber is sufficient so that the toxic and odoriferous gases are consumed before exiting. Furthermore, the upper and lower wind shrouds are needed to prevent variations in air flow and combustion in the chamber due to downwash, quenching and areas of low pressure from high wind conditions.

The embodiments of the invention in which an exclusive property or privilege is claimed are defined as follows:

1. A waste gas incinerator for burning waste gases with additional fuel gas, comprising an upright refractory lined generally cylindrical casing forming a combustion chamber and heat sink, having an open upper end and a lower end, an upper wind shroud adjacent the open upper end and a lower wind shroud adjacent the lower end, both wind shrouds having a generally cylindrical shape with a larger diameter than the casing and a plurality of openings comprising vertical slots spaced around the wind shrouds, air access at the lower end of the casing within the lower wind shroud, the access having a restriction means to limit air entry and cause turbulent air flow in the casing, fuel gas entry at the lower end of the casing, waste gas supply system within the casing having preheating means for preheating the waste gases with combustion of fuel gas and air and having means for causing turbulence of the waste gases, and waste gas entry into the casing at a location where the fuel gas and air have commenced combustion.

2. The waste gas incinerator according to claim 1 wherein the openings in the wind shrouds represent about half the area of the generally cylindrical shape.

3. The waste gas incinerator according to claim 1 including a pilot light mounted within the casing adjacent the fuel gas entry.

4. The waste gas incinerator according to claim 1 wherein the restriction means in the air access includes a plurality of air vanes positioned at an angle to give air entering the air access a swirling action to mix with the fuel gas and the waste gases within the casing.

5. The waste gas incinerator according to claim 1 wherein the preheating means and the means for causing turbulence of the waste gases includes a helical vane within an axial waste gas entry pipe and a conical deflector at the top of the entry pipe.

6. The waste gas incinerator according to claim 1 wherein the preheating means and the means for causing turbulence of the waste gases includes an axial waste gas entry pipe having a second larger pipe co-axial with the entry pipe providing an upward passage and downward passage for the waste gases within the casing, and a plurality of swirling vanes.

7. The waste gas incinerator according to claim 1 wherein the fuel gas entry includes a pipe entering the lower end of the casing, and the waste gas supply system includes a second pipe co-axial with the fuel gas entry pipe entering the lower end of the casing.

8. A method for incinerating waste gases with a fuel gas in an upright refractory lined generally cylindrical casing, having an open upper end and a lower end, comprising the steps of, feeding the fuel gas to the lower end of the casing, preventing a low pressure area at the lower end of the casing due to wind by means of a lower wind shroud, admitting a limited amount of air in a turbulent flow to the lower end of the casing to mix with the fuel gas, igniting the mixture of the air and the fuel gas within the casing, preheating the waste gases within the casing, and causing turbulence of the waste gases, feeding the preheated and turbulent waste gases into the casing to mix with the air and the fuel gas, maintaining combustion of the fuel gas and the waste gases within the casing at a sufficient temperature and for a sufficient time to attain substantially complete combustion of the waste gases before discharging from the open upper end of the casing, and preventing quenching and downwash at the open upper end of the casing due to wind by means of an upper wind shroud.

9. The method according to claim 8 wherein the limited amount of air admitted to the lower end of the casing is given a swirling movement.

* * * * *